US009732600B2

(12) United States Patent
Farshchian et al.

(10) Patent No.: US 9,732,600 B2
(45) Date of Patent: Aug. 15, 2017

(54) HEATING APPARATUS

(75) Inventors: Soheil Farshchian, Calgary (CA); Alejandro Juan, Calgary (CA)

(73) Assignee: Exponential Technologies, Inc., Calgary (CA)

( * ) Notice: Subject to any disclaimer, the term of this patent is extended or adjusted under 35 U.S.C. 154(b) by 1366 days.

(21) Appl. No.: 12/869,580

(22) Filed: Aug. 26, 2010

(65) Prior Publication Data

US 2011/0048703 A1 Mar. 3, 2011

Related U.S. Application Data

(60) Provisional application No. 61/237,445, filed on Aug. 27, 2009, provisional application No. 61/253,001, filed on Oct. 19, 2009.

(51) Int. Cl.

| | |
|---|---|
| ***F22B 31/00*** | (2006.01) |
| ***E21B 43/24*** | (2006.01) |
| ***E21B 43/243*** | (2006.01) |
| ***F22B 9/10*** | (2006.01) |
| ***F22B 25/00*** | (2006.01) |
| ***F23C 15/00*** | (2006.01) |

(52) U.S. Cl.

CPC ..... *E21B 43/2406* (2013.01); *E21B 43/243* (2013.01); *F22B 9/10* (2013.01); *F22B 25/00* (2013.01); *F23C 15/00* (2013.01)

(58) Field of Classification Search

USPC ..... 166/272.1; 122/24

See application file for complete search history.

(56) References Cited

U.S. PATENT DOCUMENTS

| | | | | |
|---|---|---|---|---|
| 2,257,749 | A * | 10/1941 | La Mont | 122/451.1 |
| 4,368,677 | A | 1/1983 | Kline | |
| 4,519,453 | A | 5/1985 | Riddiford | |
| 4,569,310 | A * | 2/1986 | Davis | B08B 3/02 122/24 |
| 4,651,712 | A * | 3/1987 | Davis | B08B 3/02 126/110 R |
| 4,895,206 | A * | 1/1990 | Price | 166/260 |
| 4,926,798 | A * | 5/1990 | Kardos | 122/24 |
| 4,960,078 | A * | 10/1990 | Yokoyama | F24H 1/206 122/24 |
| 5,211,704 | A * | 5/1993 | Mansour | 431/2 |
| 5,242,294 | A * | 9/1993 | Chato | F23C 15/00 122/17.1 |

(Continued)

FOREIGN PATENT DOCUMENTS

| | | |
|---|---|---|
| EP | 0354188 | 7/1990 |
| WO | WO2008121782 | 10/2008 |

OTHER PUBLICATIONS

Thermal Recovery Methods, Downhole Steam Generation Using A Pulsed Burner, D.A. Chesters, C.J. Clark and F.A. Riddford, BP Research Centre, Chertsey Road, Sunbury, 6 pages.

*Primary Examiner* — Alissa Tompkins
*Assistant Examiner* — John Bargero
(74) *Attorney, Agent, or Firm* — Schacht Law Office, Inc.; Dwayne Rogge

(57) ABSTRACT

Disclosed herein is a use of pulsed combustion to convert chemical energy to usable heat. For example, in boilers, heat is generated by burning fuel at burners and transferring the heat to water or other fluids, including air, through heat exchangers. In one form, these heated fluids may then be utilized to assist in removing oil from oil sand reservoirs.

22 Claims, 6 Drawing Sheets

(56) References Cited

U.S. PATENT DOCUMENTS

| | | | | |
|---|---|---|---|---|
| 5,626,193 | A * | 5/1997 | Nzekwu et al. | 166/303 |
| 6,016,773 | A | 1/2000 | Zinke | |
| 6,062,018 | A | 5/2000 | Bussing | |
| 6,161,506 | A | 12/2000 | Hanson | |
| 6,481,386 | B2 | 11/2002 | Wittchow | |
| 6,548,197 | B1 * | 4/2003 | Chandran et al. | 429/423 |
| 2008/0236817 | A1 * | 10/2008 | Tillman | 166/251.1 |

* cited by examiner

HEATING APPARATUS

RELATED APPLICATIONS

This application claims priority benefit of U.S. Ser. No. 61/237,445, filed Aug. 27, 2009 and U.S. Ser. No. 61/253,001, filed Oct. 19, 2009, each incorporated herein by reference.

BACKGROUND OF THE DISCLOSURE a) Field of the Disclosure

This disclosure relates to the field of heat generation. In one form, the disclosure relates to the use of pressure gain combustors. In one specific form, the use of pulse detonation apparatus is described.

SUMMARY OF THE DISCLOSURE

Disclosed herein are several embodiments of heat generating devices utilizing novel concepts. In one form, a pressure gain combustor, such as a pulse detonation apparatus, is utilized having at least one combustion chamber in fluid communication with a fuel inlet, an air inlet, and an ignition system. A heat exchanger, which is in thermal conductive communication with the combustion chamber, may also be utilized, the heat exchanger having a fluid inlet and a fluid outlet. A boiler in thermal conductive communication with an exhaust outlet of the combustion chamber can be used, where in one form the boiler comprises a larger flow cross-section area than the combustion chamber. The boiler has a fluid inlet and a fluid outlet. In one form, the heater is operatively configured to directly draw heat from the combustion chamber, when the combustion chamber is in operation, so as to utilize the heat produced in the pressure gain combustion process to superheat steam flowing through the heat exchanger from the boiler. An economizer may be incorporated into the apparatus, coupled to an exhaust output of the boiler wherein the economizer pre-heats boiler feed water prior to delivery to the boiler. To increase efficiency, an air pre-heater may be coupled to an exhaust output of the economizer, wherein the air pre-heater is operatively configured to conductively heat air prior to the air entering the air inlet of the pressure gain combustor.

In another embodiment, a pressure gain combustion apparatus is disclosed comprising a combustion chamber in fluid communication with a fuel inlet, an air inlet, and an ignition system, a fuel delivery system operatively configured to supply fuel to the combustion chamber and operatively configured to utilize liquid or gaseous fuel, an air intake system operatively configured to draw air at ambient pressure and supply the combustion chamber with pressurized air, and wherein the combustion chamber is operatively configured to produce pressure gain combustion or detonation of the fuel.

The pressure gain combustion apparatus may also comprise an air pre-heater coupled to an exhaust output of the combustion chamber, wherein the air pre-heater is operatively configured to conductively heat air entering the air inlet of the combustion chamber. In one form, the pressure gain combustion apparatus further comprises an exhaust heat recovery unit.

The apparatus has several uses, including a method for withdrawing oil from an underground oil reservoir through a production wellbore. In one form, the method comprises several steps. One step may be to provide a pressure gain combustion apparatus operatively configured to heat a portion of the oil within the underground oil reservoir, wherein the pressure gain combustion apparatus comprises a combustion chamber in fluid communication with a fuel inlet, an air inlet, and an ignition system. Another step may be to a fuel delivery system operatively configured to supply fuel to the combustion chamber and operatively configured to utilize liquid or gaseous fuel. In one form, an air intake system is operatively configured to draw air at ambient pressure and supply the combustion chamber of said apparatus with pressurized air. In use, a combustion chamber may be operatively configured to produce pressure gain combustion or detonation. One step may also be to provide a water jacket incorporated into the wellbore surrounding the combustion chamber of the said pressure gain combustion apparatus.

In one form, the water jacket having direct communication with the oil reservoir is provided with a sufficient number of perforations to allow fluid in the water jacket to bleed into the oil reservoir. The water jacket may be operatively configured to directly draw heat from the combustion chamber of the pressure gain combustor.

One additional step is to provide a production wellbore in proximity to the heated portion of the oil within the underground oil reservoir, and then withdrawing at least a portion of the heated oil from the reservoir through the production wellbore.

The method for withdrawing oil from an underground oil reservoir through a production wellbore as disclosed above may be arranged such that the combustion chamber is in physical communication with the underground oil reservoir so as to transfer pulses and shock waves thereto.

In one method for withdrawing oil from an underground oil reservoir through a production wellbore, the exhaust gasses from pressure gain combustion are forced into the reservoir.

In another form, the method for withdrawing oil from an underground oil reservoir through a production wellbore comprises the step of recycling the exhaust gasses with an exhaust heat recovery unit.

DESCRIPTION OF THE PREFERRED EMBODIMENTS

Figure 1:
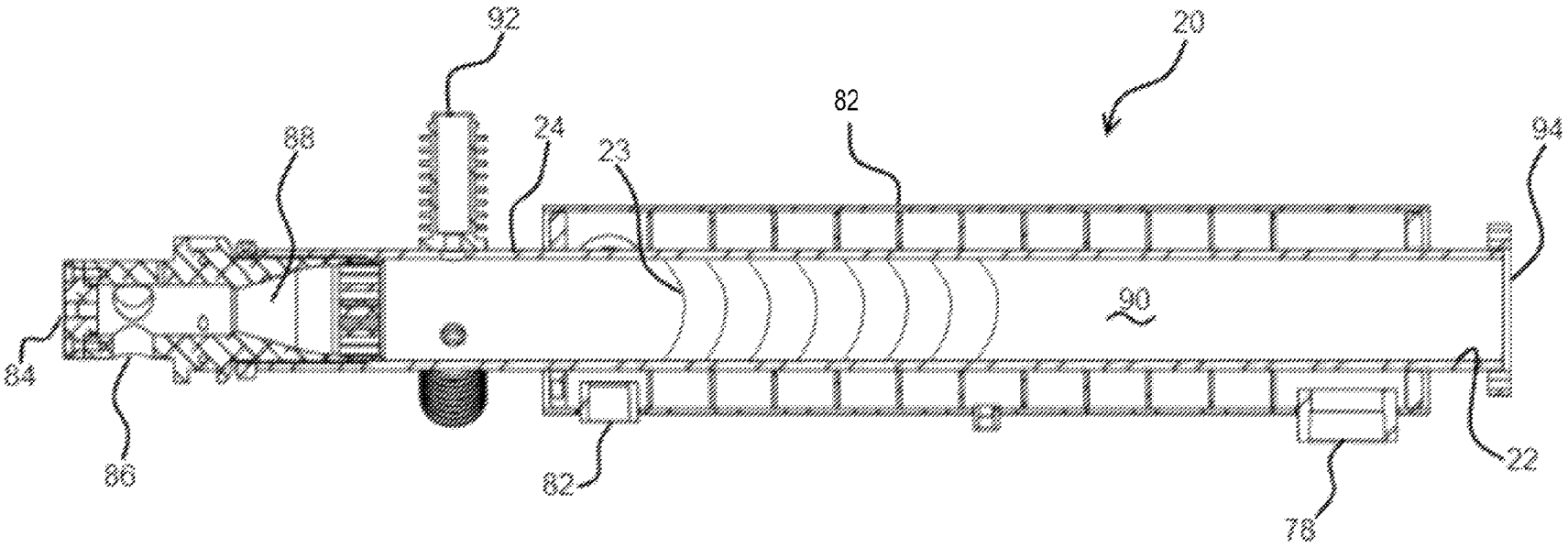
FIG. 1 is a side cutaway view of a pulse detonation heating apparatus, in one form.

Disclosed herein is a heating apparatus in several forms which builds on several known concepts:

Fossil fuels are combusted in burners to turn chemical energy into heat.

Burners are constructed in various sizes and styles.

Most burners use a continuous-burn regular combustion.

Burners are used in several applications, mainly power generation.

For example, in steam boilers heat is generated by burning fuel at burners and transferring the heat to water or other fluids, including air, through heat exchangers. Use of a pulse combustion burner for boilers has been proposed in U.S. Pat. No. 4,368,677. As another example, U.S. Pat. No. 6,161,506 describes a pulse combustion boiler for high capacity saturated steam generation. In this patent disclosure, combustion is repeated at the resonant frequency of the inlet flapping valves. Likewise, U.S. Pat. No. 6,016,773, incorporated herein by reference, introduces a pulse combustion boiler that runs similar to the aforementioned patents. The fundamental heating loss associated with conventional heating devices, such as steam boilers, is mainly due to flame stabilization, turbulence, dilution of the products of primary combustion and flame tube cooling. Further loss occurs because the air, heated at constant pressure, suffers a reduction in density and increase in velocity.

Presented here is an apparatus to convert chemical energy to heat energy using "pressure gain combustion" (PGC). The process results in an overall gain in the stagnation pressure rather than the pressure loss associated with conventional combustion. The pressure rise associated with the process results in higher combustion temperatures as well as the corresponding increase in thermal efficiency and specific power. Pressure gain combustion may be produced either by a constant volume combustion process, detonation combustion or a combination of both conditions. In detonation, the combustion process is high speed and the reaction approaches a constant volume process. The resulting shock wave structure of the developed supersonic wave raises the temperature and pressure substantially to cause very high reaction rates and energy release that sustain the wave propagation.

One form of pressure gain combustion device is a pulse detonation combustor (PDC). Current research on pulse detonation by others is mainly concentrated on thrust generation for aerospace applications. However, to date it has not been proposed as a heat generation means for steam boiler 82 (having an inlet 78 and an outlet 82) or heating applications.

In pulse detonation, the combustion chamber 90, usually a tube closed at one end 88 is periodically filled with a reactive mixture via a fuel injector 84. The initial deflagration of the combustible mixture is rapidly transformed into a detonation either by a deposition of a large amount of energy, flame acceleration using turbulence generators or shock focusing. Upon detonation, this violent thermodynamic process creates a shockwave 23 that travels the length of the chamber 90. When the shock wave reaches the end 94 of the chamber all of the combustion products are discharged at once. As soon as the products exit, the pressure inside the chamber drops suddenly resulting in air entering its air inlet 86 and the filling process is repeated.

In a pulsed detonation system 20, as shown in one embodiment in FIG. 1, the heat generation and heat transfer to the walls 22 is maximum at the detonation sections. The temperature of the combusting gasses in the detonation process is higher than a regular burning process. For a regular burn process, internal energy of fuel is extracted at constant pressure, hence:

$$Q = m \cdot C_P \cdot \Delta t_{comb}$$

or $$\Delta t_{comb} = \frac{Q}{m \cdot C_p}$$

In these equations, Q is the fuel energy, m is the mass of air in the combustion chamber, Cp is air specific heat in a constant pressure process and Δtcomb is the temperature increase in the air. Due to the low fraction of fuel mass, it could be neglected in this calculation. Under CJ detonation condition, heat is generated at constant volume combustion. Therefore, the rise in air temperature will be:

$$\Delta t_{CJ} = \frac{Q}{m \cdot C_V}$$

Where $\Delta t_{CJ}$ is the temperature increase in CJ detonation and $C_V$ is the specific heat of air under the constant volume process. Therefore, the ratio of the raise in temperature between the two processes will be:

$$\frac{\Delta t_{CJ}}{\Delta t_{comb}} = \frac{C_V}{C_P} = K$$

Here, K is the ratio of the specific heats and is a constant property of the operating fluid. The constant K for air is larger than unity at all pressures and temperatures and K=1.33 at standard pressure and temperature conditions. Therefore, the temperature rise under CJ condition is higher compared with conventional constant pressure combustion. In PDC, the CJ condition is satisfied in the propagating detonation waves, thusly, the highest temperatures in the apparatus are observed along the walls of the combustor tube 22.

Several applications of PGC are indicated here and the advantage of utilizing the PDC apparatus 24 for each application is explained. Another application of pulse detonation combustion is direct or indirect heating of Liquid Natural Gas (LNG) in the re-gasification process. Further PGC may be used to directly heat the LNG in a heat exchanger or heat an operating fluid that transfers the heat to LNG (indirect heating). The application of the PGC are not limited to the said applications and the PGC may be utilized in other heating processes.

Application in Steam Generation

Figure 2:
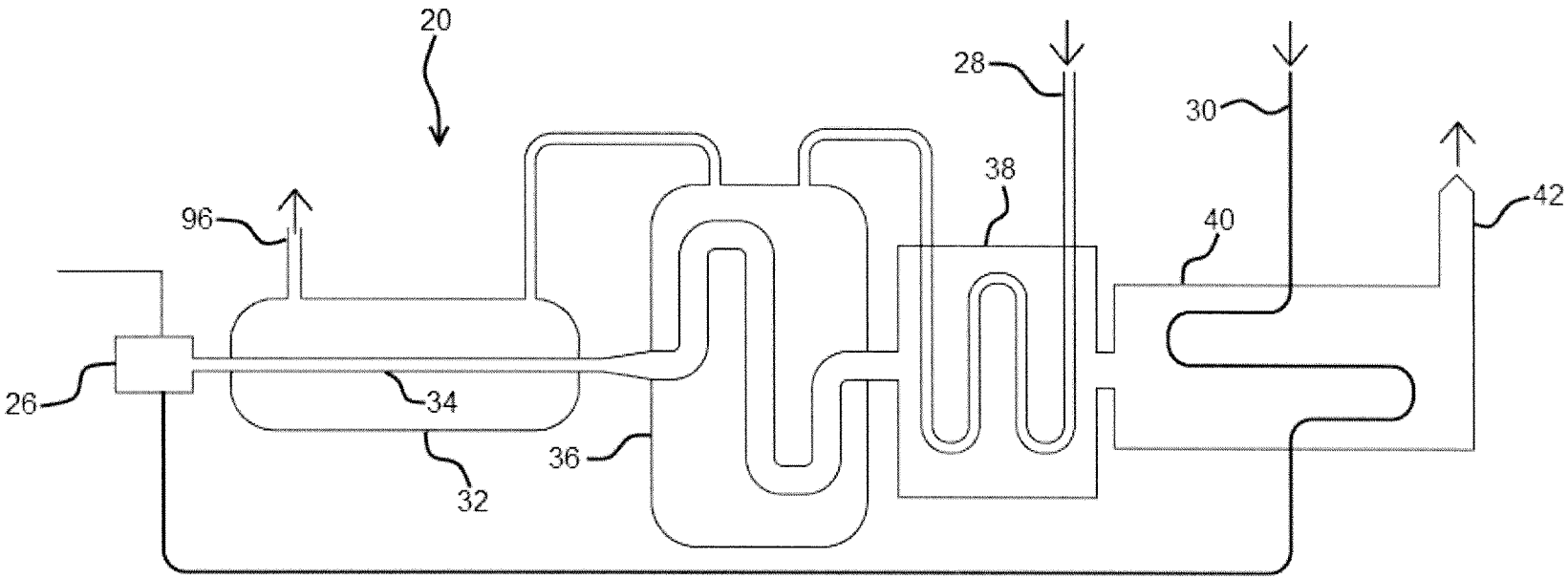
FIG. 2 is a highly schematic diagram of a pulse detonation steam generation boiler, in one form.

The arrangement shown in FIG. 2 is one possible configuration for superheated steam generation using a PGC. An exemplar pressure gain apparatus 26 is used to detonate a fuel and air mixture. The combustion products are passed through a series of heat exchangers to heat feed water 28 and intake air 30. A steam superheater 32 is in direct contact with the combustion chamber 34 similar to a tubular heat exchanger. Another advantage of the disclosed design is that due to the shock waves and resultant vibrations produced by the detonations, convective heat transfer rate to the walls 22 is significantly higher than that of conventional methods. Utilizing a tubular heat exchanger in this region, the saturated steam is heated to a superheated steam. Fins and baffles may be used on the heat exchanger to increase the heat transfer surface area. Once the detonation shock wave exits the PDC, it enters the boiler chamber 36. The boiler chamber 36, in one form, has a larger flow cross-section area; therefore, the high-pressure shock wave expands and propagates in the boiler.

The boiler 36 may be a fire tube or water tube design. In both designs the existence of pressure pulses and variation in flow speed improves the heat transfer between the hot combustion gases and water. The constant change in the flow speed and pressure pulses prevents steady state boundary layers to develop on the heat exchanger walls, and thus increases the heat transfer coefficient on the heat exchanger surfaces. Further, the vibration caused by the pressure pulses could potentially reduce fouling on the heat exchanger surfaces. The fill fraction of air-fuel mixture may be varied depending on the heat required in the boiler. If extra heat is required in the boiler, the fill fraction is increased such that part of the mixture would combust in the boiler chamber rather than detonating in the pulse combustion chamber.

The combustion products enter the economizer 38 and air pre-heater 40, where heat is transferred to the feed water 28 and feed air 30, respectively. The combustion products are exhausted at the air pre-heater outlet 42. The superheated steam 96 may then be utilized for other applications. The existence of pressure pulses in PDC in some embodiments causes a push force for the combustion products through the heat exchanger stages. Therefore, the need for intake fans is eliminated. This also allows for greater heat extraction from the combustion gases, as stack effects are not required for the exhaust gas. It should be noted that the heat exchangers in this steam generation setup are not limited to a specific type or category. Fuel for the PGC apparatus can either be gaseous or liquefied. Several heat exchanger stages or pressure gain combustors may be utilized depending on the application and the required steam generation capacity. Further, the PGC steam generation apparatus is scalable in size and heating capacity.

Application in Oil Recovery

Another application for pressure gain combustion is in enhanced oil recovery technology to extract heavy crude oil and bitumen in oil sands reservoirs that are too deep to mine.

Figure 5:
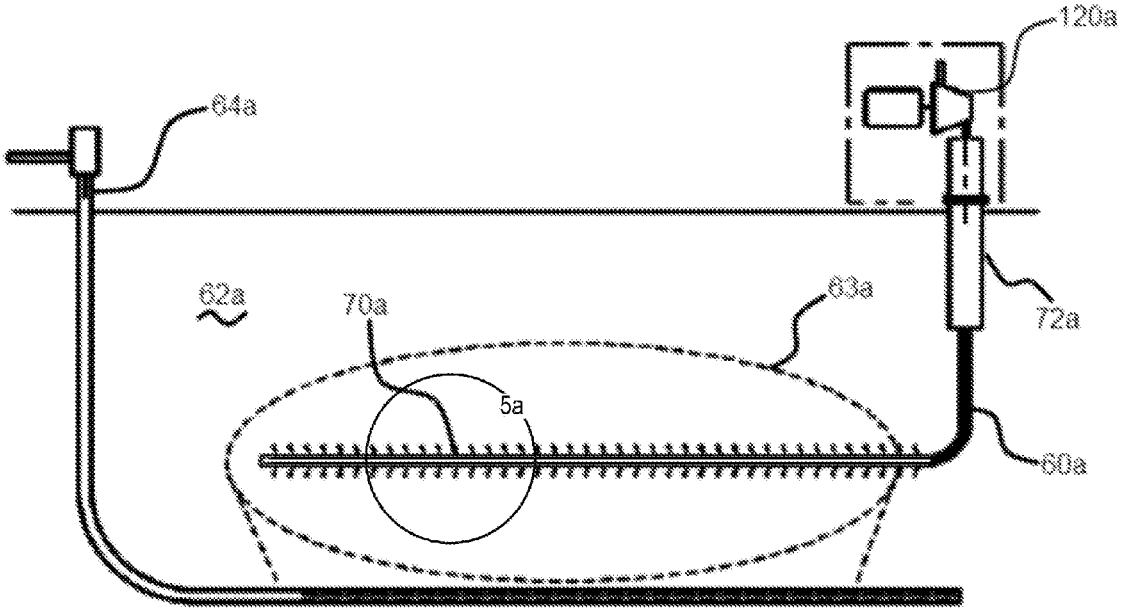
FIG. 5 is a highly schematic diagram of a pressure gain boiler device in one form, used in an oil recovery process.
Figure 5A:
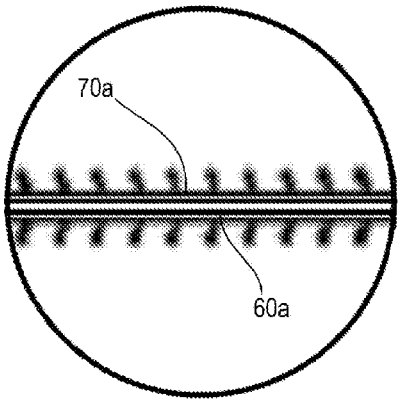
FIG. 5*a* is an enlarged view of the area 5*a* of FIG. 5.
Figure 6:
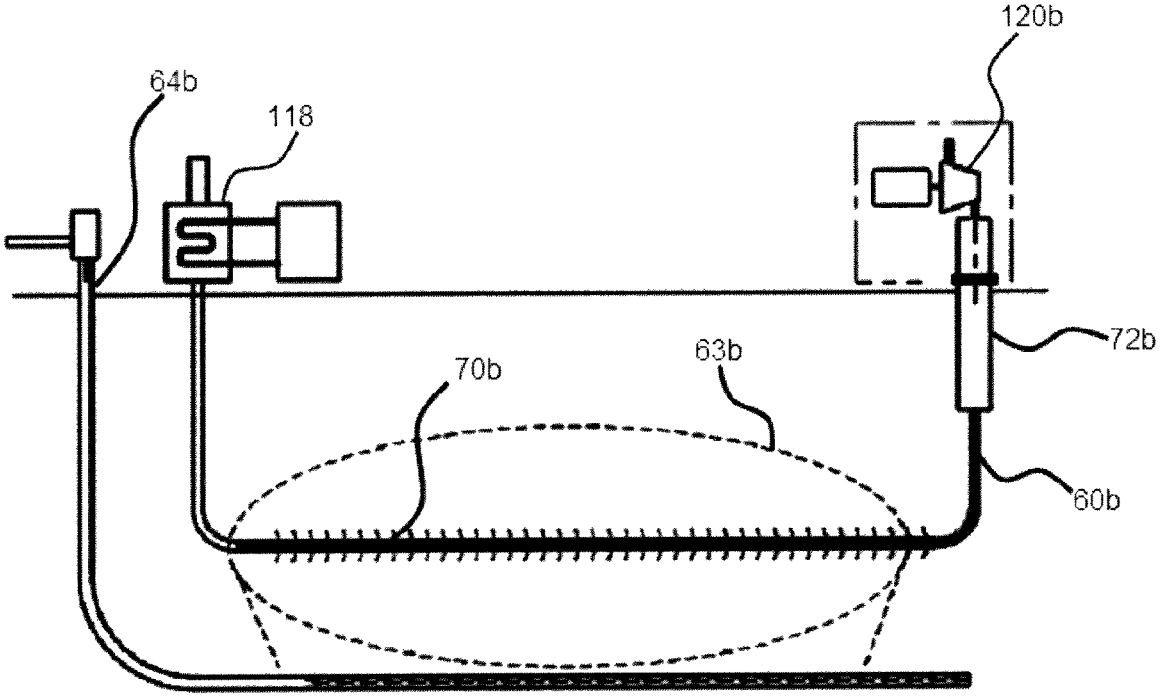
FIG. 6 is a highly schematic diagram of a pressure gain boiler device with a heat exhaust recovery unit in one form, used in an oil recovery process.

The most common exploitation process is Steam Assisted Gravity Drainage (SAGD) where pair of horizontal wells is drilled several meters apart; one well bore below the other, and placed near the base of the reservoir. High-pressure steam produced from boilers on the surface is continuously injected into the upper well bore which permeates the reservoir creating a steam chamber, such as 63*a*, as shown in FIG. 5, and 63*b*, as shown in FIG. 6. The heat from the steam reduces the viscosity of the bitumen, allowing it to drain down into the lower well bore 64 where it is pumped to the surface.

Figure 3:
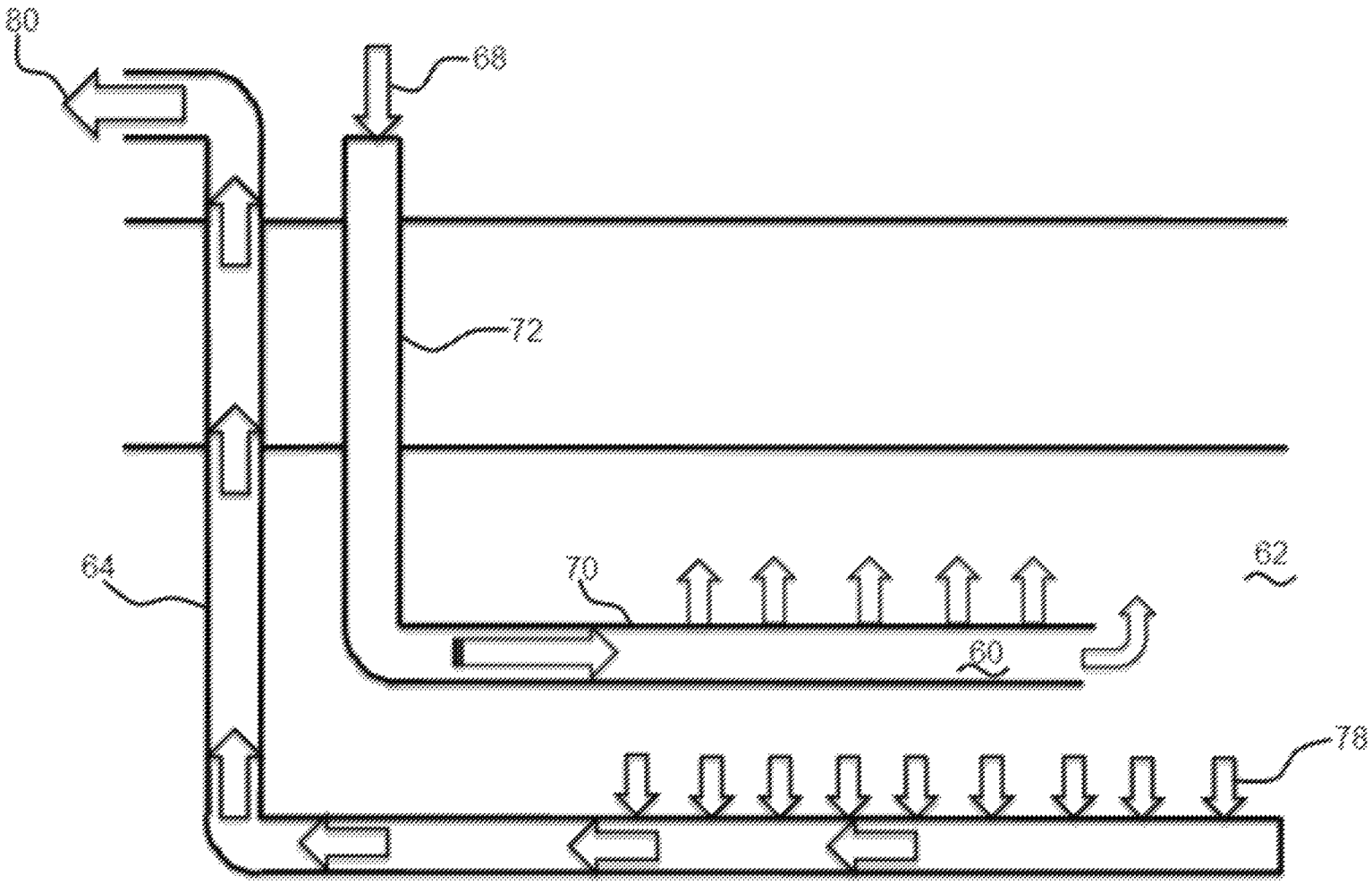
FIG. 3 is a highly schematic flow diagram of a pressure gain combustion device used in an oil recovery process.

Depicted in FIG. 3 is a configuration of typical a SAGD operation, wherein high-pressure steam 68 from a boiler is injected into the wellbore 72. Perforations 70 in the well bore allow the steam to permeate through the reservoir 62, forming a steam chamber which grows vertically and laterally. The heated bitumen is less viscous and oil flows in the direction 78 into the production well 64 where the recovered oil 80 is withdrawn.

Figure 4:
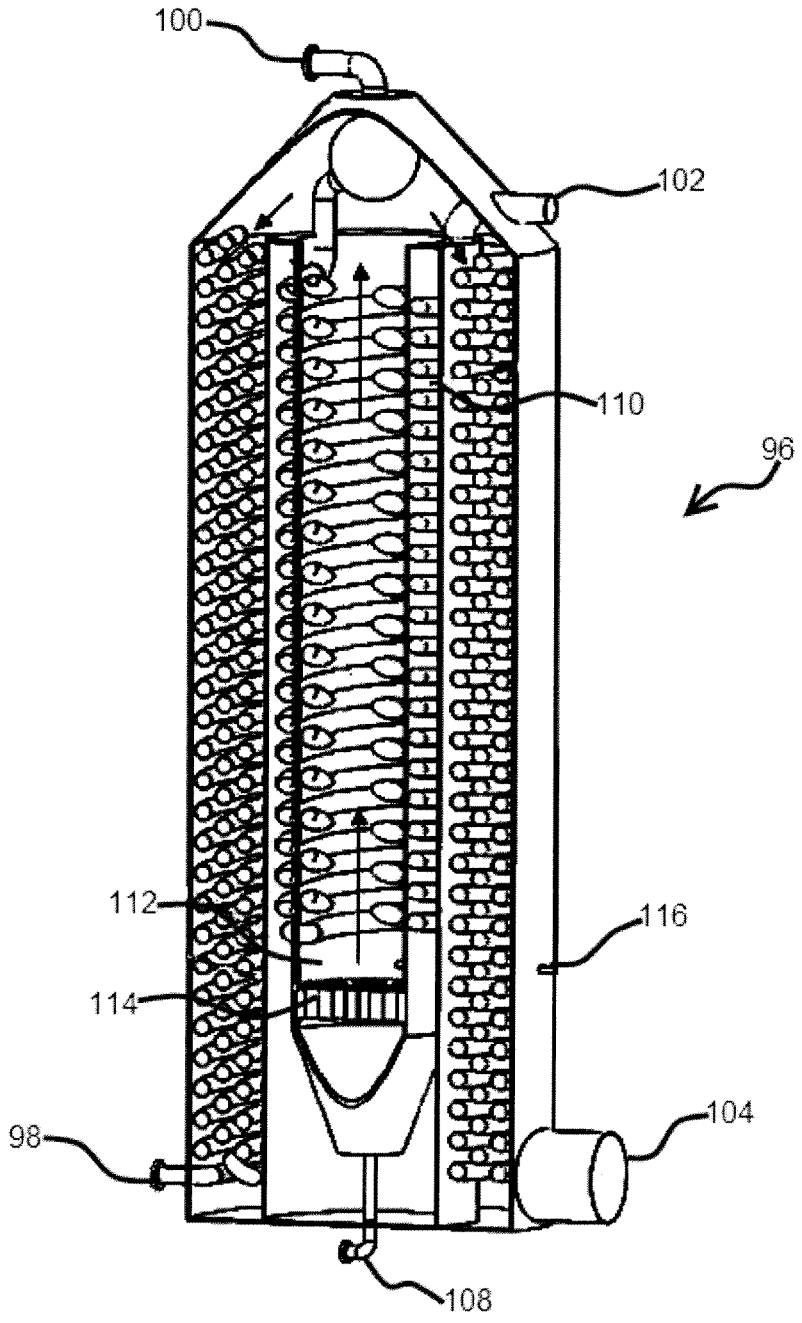
FIG. 4 is a highly schematic view of a pressure gain boiler, in one form.

Looking to FIG. 4, the steam supply 68 for the aforementioned conventional SAGD process may incorporate a pressure gain boiler 96 having a cold-water inlet 98, high-pressure steam outlet 100, compressed air intake 102, combusted gas exhaust 104, and fuel injection port 108. A preheater 110 is fluidly coupled between the compressed air intake 102 and the combustor tube 112 with a diffuser 114 positioned therebetween, in one form. An ignition source 116 may be utilized to ignite the gas within the combustion tube.

Another method is to develop superheated steam in the well bore located in the reservoir utilizing PGC. The embodiment of such an apparatus is illustrated in FIG. 5, wherein the combustion tube 60*a* is situated annularly inside the water pipe 70*a* within the wellbore 72*a*. Compressed air and fuel are forced into the combustion tube via the air compressor 120 located on the surface. Heat is generated in the combustion tube by the detonation of the air-fuel mixture therein. The combustion products from the detonation are exhausted directly through the inner surface of the wellbore into the reservoir and generally remain therein. Perforations in the water tube 70*a* allow the water to bleed into the reservoir, which turns into steam when heated continuously by the combustion tube.

Alternatively, the embodiment shown in FIG. 6 depicts a similar PGC apparatus as in FIG. 5 except that the combustion products are exhausted into a heat recovery unit 118 located on the surface rather than into the reservoir, as previously described.

The advantages of the aforementioned PGC application are:

- Increased thermal efficiency: all the energy of the burnt fuel is transferred to the reservoir, since the combustor is located in the wellbore and the exhaust is also open to the reservoir.
- Heat is transferred to the reservoir by convection of exhaust gases from the combustor. The process is not limited to conduction heating.
- The pressure oscillations caused by the pressure gain combustion are directly transferred to the reservoir which would increase the mass transfer as well as increase the flow of heavy oil in the reservoir by reduction of capillary forces caused by pressure pulsing and vibration.
- The excessive air injected to the reservoir by the combustion process can be used for combustion in formation, which will effectively increase the heat generation rate in the formation.

It shall be noted that the scope of this patent is not limited to pulse detonation combustion. It is clear for experts in the art that the design and applications explained here are not limiting the scope of this patent and that similar designs may be utilized for other applications. The patent covers all the applications of pulse combustion for the aforementioned applications. The pulse detonation combustor can be modified to operate as a pulsejet. This patent discloses the application of pulse combustion methods in oil recovery applications, including pulse detonation, pulsejet and pulse combustion.

A pulsejet engine brings air into the combustion chamber and there is regular burn therein. With pulse combustion there is increased pressure in the combustor there is a pulsejet with a relatively small shock wave. The most preferred form is pulse detonation, where combustion is controlled by fuel combustion and ignition processes. The combustion frequency is executed where fuel is burned simultaneously, so the shockwave is higher in the order of Mach 3 to Mach 4, and further, the burning is at a higher temperature, which creates a higher form of combustion and higher efficiency. These various processes, pulsejet, pulse combustion and pulse detonation can be utilized and any kind of pulse combustion can be utilized for this process.

Key Features

Fuel is burned in a constant volume detonation process. In this process, the highest efficiency is obtained from the combustion process.

Detonation results in higher flame temperatures compared to regular burn combustion.

Pulse detonation process results in higher flame temperature as well as higher heat exchanger heat transfer rate.

Steam super-heater is located at the pulse detonation combustor where maximum heat is transferred to steam from detonation process.

High-pressure shock waves eliminate the need for intake air blowers or high temperature convective exhaust.

The disclosure, in its broader aspects, is therefore not limited to the specific details, representative apparatus and methods, and illustrative examples shown and described. Accordingly, departures may be made from such details without departing from the spirit or scope of applicants' general concept.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

We claim:

1. A pressure gain combustion apparatus comprising:

a. a combustion chamber in fluid communication with a fuel inlet, an air inlet, and an ignition system;

b. a fuel delivery system operatively configured to supply fuel to the combustion chamber and operatively configured to supply liquid or gaseous fuel to the combustion chamber;

c. an air intake system in fluid communication with the combustion chamber, the air intake system operatively configured to draw air at ambient pressure and supply the combustion chamber with pressurized air;

d. the combustion chamber operatively configured to produce pressure gain combustion or detonation of the fuel;

e. a heat exchange device operatively configured draw heat from combusted gasses produced during combustion or detonation;

f. further comprising conduits comprising an air preheater in physical contact with an outer surface of the combustion chamber to conduct thermal energy therefrom;

g. wherein the air pre-heater pre-heats the air entering the combustion chamber.

2. The pressure gain combustion apparatus as recited in claim 1 further comprising an exhaust heat recovery unit.

3. The pressure gain combustion apparatus as recited in claim 1 wherein the pressure gain combustor is a pulse detonation apparatus.

4. A method for withdrawing oil from an underground oil reservoir through a production wellbore, the method comprising the steps of:

a. providing a pressure gain combustion apparatus operatively configured to heat a portion of the oil within the underground oil reservoir;

i. wherein the pressure gain combustion apparatus comprises a combustion chamber in fluid communication with a fuel inlet, an air inlet, and an ignition system;

ii. a fuel delivery system operatively configured to supply fuel to the combustion chamber and operatively configured to utilize liquid or gaseous fuel to the combustion chamber;

iii. an air intake system operatively configured to draw air at ambient pressure and supply the combustion chamber of said apparatus with pressurized air;

iv. the combustion chamber operatively configured to produce pressure gain combustion or detonation of the fuel;

b. a heat exchange device operatively configured to draw heat from combusted gasses produced during combustion or detonation;

c. the heat exchange device in direct physical contact with walls of the combustion chamber to heat a fluid within the heat exchange device, wherein the fluid within the heat exchange device is not in fluid communication with the combustion chamber;

d. the combustion chamber within an underground wellbore wherein the combustion chamber is annularly surrounded by the wellbore;

i. wherein the wellbore is in fluid communication with an underground reservoir;

ii. wherein the wellbore is radially outward of the combustion chamber to allow transfer of the heated fluid radially outward from the outer surface of the combustion chamber directly through the wellbore into the reservoir; and iii. wherein the combustion chamber is in physical communication with an underground reservoir, so as to transfer pulses and shock waves thereto;

e. providing a production wellbore in proximity to the heated portion of the oil within the underground oil reservoir; and f. withdrawing at least a portion of the heated oil from the reservoir through the production wellbore.

5. The method for withdrawing oil from an underground oil reservoir through a production wellbore as recited in claim 4 wherein the exhaust gasses from pressure gain combustion are forced into the reservoir.

6. The method for withdrawing oil from an underground oil reservoir through a production wellbore as recited in claim 4 further comprising the step of recycling exhaust gasses with an exhaust heat recovery unit.

7. The method for withdrawing oil from an underground oil reservoir through a production wellbore as recited in claim 4 further comprising the step of providing a water jacket incorporated into the wellbore surrounding the combustion chamber of the said pressure gain combustion apparatus;

i. the water jacket having direction communication with the oil reservoir is provided with sufficient number of perforations to allow fluid in the water jacket to bleed into the oil reservoir, and ii. wherein the water jacket is operatively configured to directly draw heat from the combustion chamber of the pressure gain combustor.

8. A pressure gain combustion apparatus comprising:

a. a combustion chamber in fluid communication with a fuel inlet, an air inlet, and an ignition system;

b. a fuel delivery system operatively configured to supply fuel to the combustion chamber and operatively configured to supply liquid or gaseous fuel to the combustion chamber;

c. an air intake system in fluid communication with the combustion chamber, the air intake system supplying the combustion chamber with air;

d. the combustion chamber operatively configured to produce pressure gain combustion or detonation of the fuel;

e. a heat exchange device operatively configured to draw heat from combusted gasses produced during combustion or detonation;

f. the heat exchange device in direct physical contact with walls of the combustion chamber to heat a fluid within the heat exchange device, wherein the fluid within the heat exchange device is not in fluid communication with the combustion chamber;

g. the combustion chamber within an underground wellbore wherein the combustion chamber is annularly surrounded by the wellbore;

i. wherein the wellbore is in fluid communication with an underground reservoir;

ii. wherein the wellbore is radially outward of the combustion chamber to allow transfer of the heated fluid radially outward from the outer surface of the combustion chamber directly through the wellbore into the reservoir; and iii. wherein exhaust from the combustion chamber is in physical communication with an underground reservoir, so as to transfer pulses thereto.

9. The pressure gain combustion apparatus as recited in claim 1 wherein an exhaust output of the pressure gain combustion is in fluid communication with a reservoir such that exhaust gasses from pressure gain combustion are forced into the reservoir.

10. The pressure gain combustion apparatus as recited in claim 1 further comprising a heat recovery unit in fluid communication with an underground reservoir to facilitate the recycling of heat from exhaust gasses of the pressure gain combustion apparatus.

11. The pressure gain combustion apparatus as recited in claim 8 wherein the wellbore comprises an inlet at a first end and an outlet a second end wherein the inlet and outlet are at different surface locations.

12. The pressure gain combustion apparatus as recited in claim 11 further comprising a heat recovery unit in fluid communication with the wellbore outlet to facilitate the recycling of heat from exhaust gasses.

13. The pressure gain combustion apparatus as recited in claim 8 wherein the wellbore comprises a plurality of perforations radially outward of the heat exchange device for exhausting into the reservoir.

14. The pressure gain combustion apparatus as recited in claim 8 wherein the fluid is a solvent.

15. The pressure gain combustion apparatus as recited in claim 14 wherein the solvent is selected from the group consisting of liquid natural gas, and water.

16. The pressure gain combustion apparatus as recited in claim 8 wherein the fluid comprises a petroleum-based product.

17. The pressure gain combustion apparatus as recited in claim 16 wherein the fluid comprises liquid natural gas.

18. The pressure gain combustion apparatus as recited in claim 1 further comprising a boiler in thermal conductive communication with an exhaust outlet of the combustion chamber, wherein the boiler comprises a larger flow cross-section area than the combustion chamber, the boiler having a fluid inlet and a fluid outlet.

19. The pressure gain combustion apparatus as recited in claim 18 wherein the heater is operatively configured to directly draw heat from the combustion chamber, when the combustion chamber is in operation so as to utilize heat produced in the combustion chamber to superheat steam flowing through the heat exchanger from the boiler.

20. The pressure gain combustion apparatus as recited in claim 18 further comprising an economizer coupled to an exhaust output of the boiler; wherein the economizer preheats boiler feed water prior to delivery to the boiler.

21. The pressure gain combustion apparatus as recited in claim 20 wherein the air pre-heater is coupled to an exhaust output of the economizer, wherein the air pre-heater is operatively configured to conductively heat air prior to the air entering the air inlet of the pressure gain combustor.

22. The pressure gain combustion apparatus as recited in claim 1 wherein the heat exchange device comprises a hollow spiral baffle not fluidly coupled to and positioned within the combustion chamber;

a. the hollow spiral baffle having a radially outer surface in contact with an inner wall of the combustion chamber;

b. the hollow spiral baffle forming a fluid conduit to a steam outlet; and c. wherein steam is generated in the hollow spiral baffle and exits the combustion chamber via a steam outlet.

* * * * *